US005893530A

United States Patent [19]

Alexander, III et al.

[11] Patent Number: 5,893,530

[45] Date of Patent: Apr. 13, 1999

[54] CUSHIONING APPARATUS FOR WEB ROLL LET-OFF AND METHOD

[75] Inventors: William J. Alexander, III, Mauldin; Minnerd A. Blegen, Simpsonville, both of S.C.

[73] Assignee: Alexander Machinery, Inc., Mauldin, S.C.

[21] Appl. No.: 08/844,959

[22] Filed: Apr. 23, 1997

Related U.S. Application Data

[63] Continuation of application No. 08/704,253, Aug. 28, 1996, abandoned.

[51] Int. Cl.[6] ..... B65H 19/00; B65H 16/10

[52] U.S. Cl. ..... 242/559; 242/564.5

[58] Field of Search ..... 242/558, 559, 242/564.5, 559.1, 533.3, 533, 550, 542.2, 542, 561

[56] References Cited

U.S. PATENT DOCUMENTS 5,209,418 5/1993 Alexander, III ..... 242/558

*Primary Examiner*—John Q. Nguyen
*Attorney, Agent, or Firm*—Ralph Bailey

[57] ABSTRACT

Apparatus and method for cushioning the impact when placing a web roll on a belt let-off has pneumatic cylinders (A) operating bell crank arms (B) for raising a roll carried on one end (C) while lowering a roll (D) carried on an opposite end of the bell crank for tightening the belt (F) ejecting an empty core roll preparatory to receiving a web roll (W) which is supported by the arms (B) while being lowered and cushioned by the air cylinders until it is received and supported for rotation in a cradle formed by the belt (F) for unwinding.

5 Claims, 5 Drawing Sheets

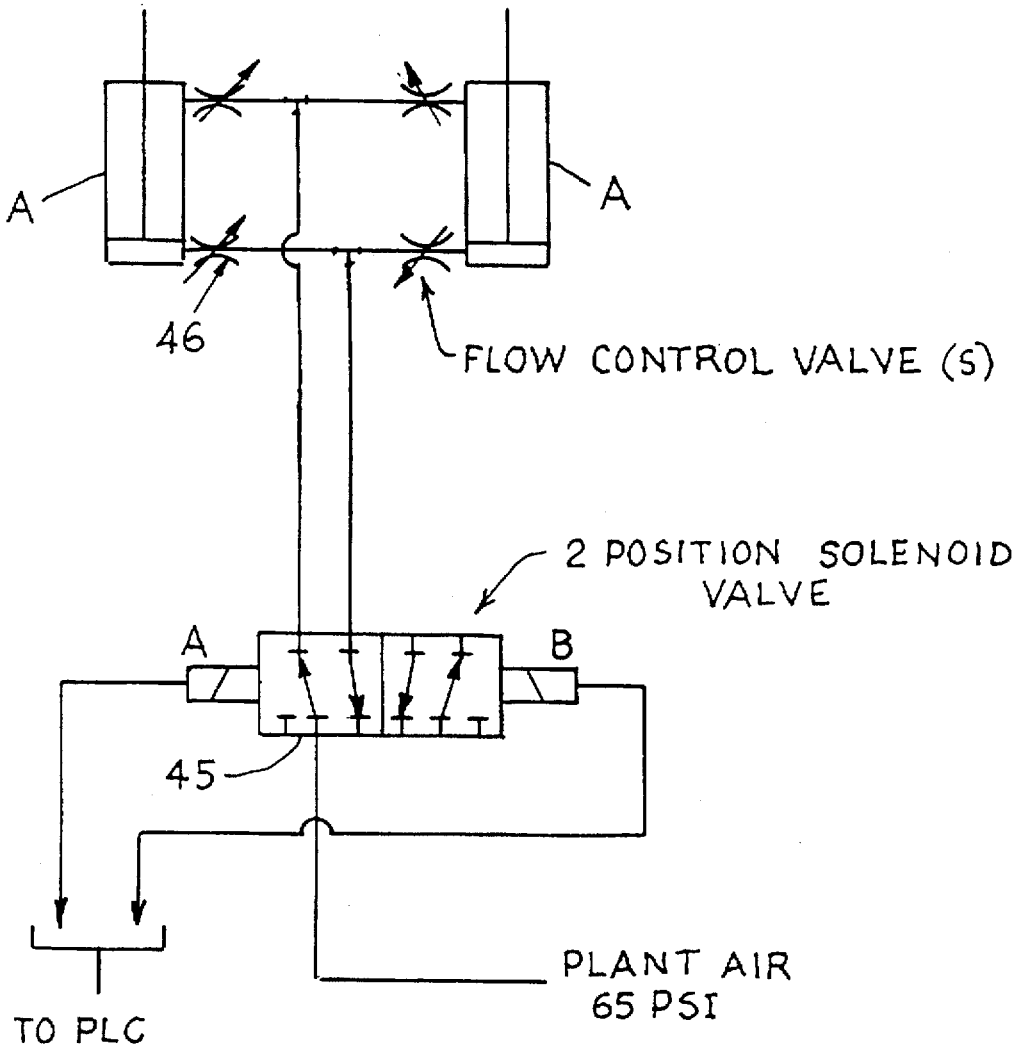
Fig. 5.
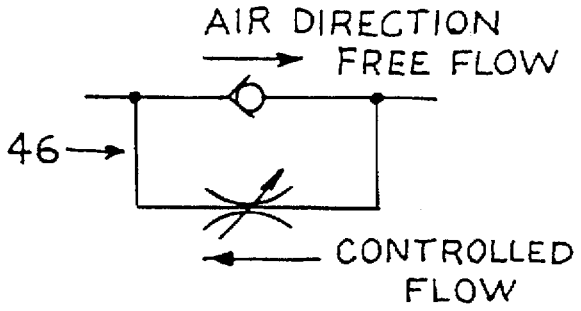
Fig. 5-A.

CUSHIONING APPARATUS FOR WEB ROLL LET-OFF AND METHOD

This application is a continuation of application Ser. No. 08/704,253, filed Aug. 28, 1996, abandoned.

BACKGROUND OF THE INVENTION

This invention relates to let-off apparatus for positioning a support for receiving a web roll, for cushioning the impact of the web roll when being placed upon the let-off, and thereafter for carrying the web roll for rotation during unwinding.

Several kinds of let-offs are provided for use in unwinding the web from a web roll including center wound and surface wound let-offs as well as belt let-offs illustrated in U.S. Pat. No. 5,209,418. The apparatus of the invention may be used to greatest advantage upon the belt let-off but may be useful in connection with other let-offs as well.

A major problem in connection with the placing of a web roll upon a belt let-off results from the force with which extremely large web rolls, which may weigh on the order of about 6,000 pounds, are rolled into a cradle formed by the belt provided for supporting and rotating the web roll during unwinding. The impact exerted by a full web roll being placed upon a belt let-off may cause damage to the web or to the apparatus involved in placing and receiving the web roll. Moreover, the placement of the web rolls is very noisy disrupting the activities of personnel engaged in the web handling operations.

When doffing an empty roll core, after completion of the unwinding of a web roll, the belt of a belt let-off may be pulled as by moving one of the cradle support rolls outwardly and downwardly causing the empty roll core to roll off the belt. When in this position a full web roll is rolled upon the belt causing the belt to be snapped into its cradle configuration because at this point in the operating sequence of the let-off minimal support for the web roll is offered by the belt until it is pulled taught in its cradle configuration for supporting the web roll during unwinding.

It would conserve time and simplify the operation of the belt let-off if, instead of creating a problem, such positioning of the belt for discharging the empty roll core could thereafter be utilized to facilitate the placement of a full roll core as well as to cushion the impact thereof as it is rolled into operating position on the belt.

SUMMARY OF THE INVENTION

Accordingly, it is an important object of the invention to provide a cushioning apparatus for dampening the impact of a web roll when it is received upon a let-off especially a belt let-off.

Another important object of the invention is the provision of cushioning apparatus to avoid damage to the web material and to the let-off apparatus involved in receiving and positioning the web roll for rotation during unwinding.

Another important object of the invention is to avoid noise and the disruption of activities of personnel engaged in dewinding.

Still another object of the invention is to provide let-off apparatus serving to facilitate reception of the web roll after discharge of an empty roll core and then offering support therefor cushioning the impact of the full web roll lowering same into operating position.

Not only may the apparatus and method of the invention be utilized in connection with cloth having been manufactured on a weaving machine but also the method and apparatus of the invention may be utilized with a variety of webs including non-wovens, plastic sheets, paper and the like.

It has been found that a first support may be mounted on the let-off for receiving and carrying a substantial portion of the weight of the web roll when rolled upon the let-off which includes a pneumatic device such as air cylinders for operating a pair of transversely spaced pivoted arms, such as bell cranks, carrying rolls rotatably mounted therebetween on respective ends. The rolls move to tighten the belt ejecting an empty roll core and for receiving the full web roll while the arms carry the web roll, lowering same by gravity into position for unwinding.

As alternatives to air cylinders with pivoted operating arms, other pneumatic devices such as air bags may be utilized as beneath the belts of the belt let-offs to cushion the impact of web rolls when placed upon a let-off.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 5 is a schematic diagram illustrating the pneumatic device and operating mechanism; and FIG. 5-A is an enlarged view further illustrating check flow valves employed in operating the pneumatic device.

DESCRIPTION OF A PREFERRED EMBODIMENT

The drawings illustrate apparatus for cushioning the impact of a web roll W when placed upon a let-off preparatory to unwinding the web roll. A first support is mounted on the let-off receiving and carrying a substantial portion of the weight of the web roll for placement of the web roll in operating position upon the let-off. The first support includes pneumatic devices A from which air is exhausted under the weight of the web roll permitting it to be lowered against a cushioning support of air provided by the pneumatic devices.

Pivoted arms B carry a roll C for rotation on one end thereof. The arms B are moved responsive to the pneumatic devices for moving the roll C upwardly for receiving the web roll, and for moving a cradle support roll D carried for rotation on the other end of the pivoted arm B downwardly and outwardly. The arms B are illustrated in the form of bell cranks pivoted between the rolls C and D as at E. A second support which includes an endless belt F is moved to a position to receive the web roll responsive to the downward and outward movement of the roll D. The roll C, together with the belt, carries the web roll when lowered thereon to a position in a cradle for rotation on the belt during unwinding. Thus, the web roll is received upon the first support and gradually lowered by gravity into position for commencing unwinding of the web upon the let-off.

Figure 1:
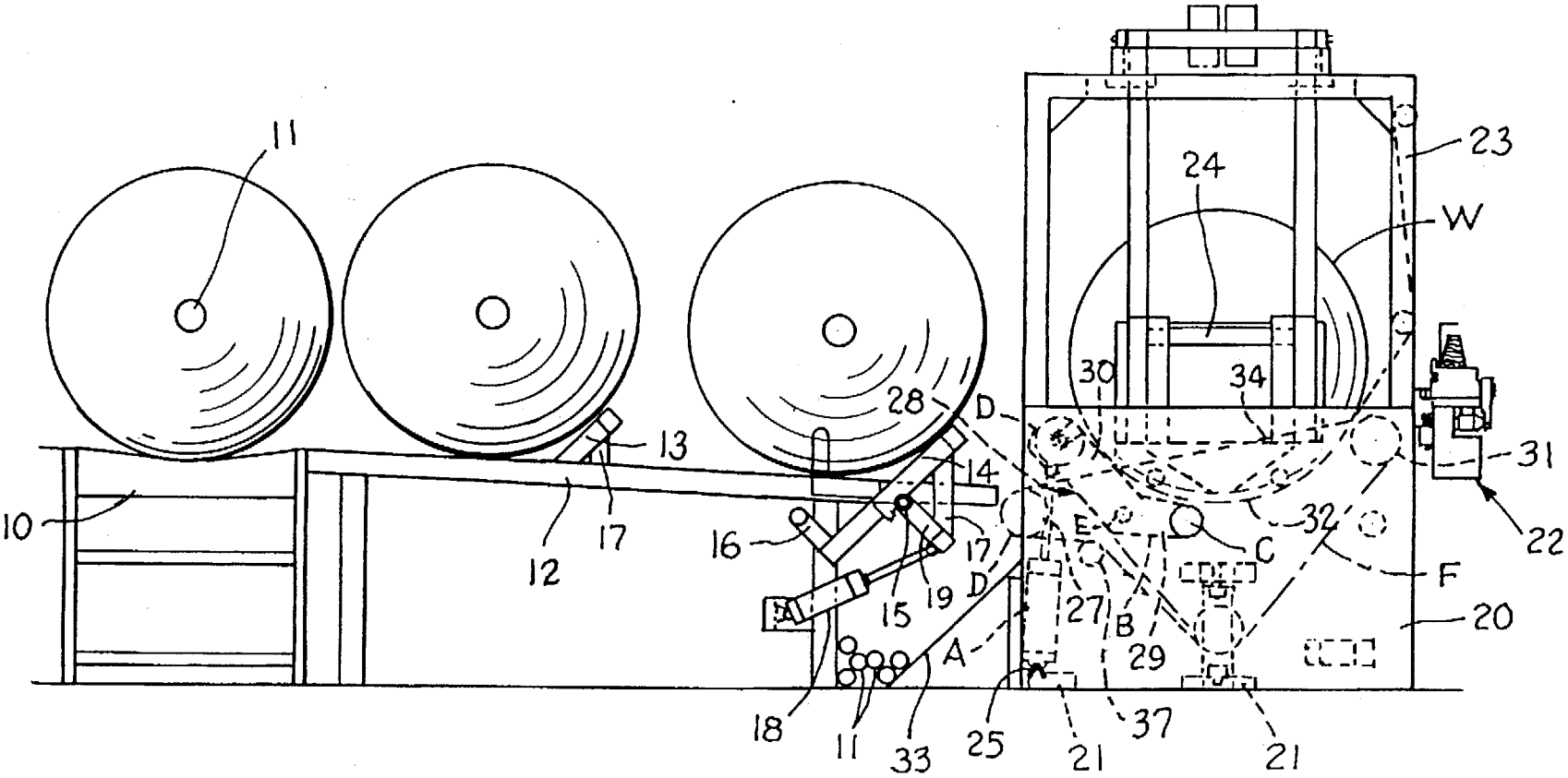
FIG. 1 is a side elevation illustrating a belt let-off, receiving a full web roll from a table which in turn receives a series of web rolls as from a conveyor for successive placement upon the belt let-off during dewinding, wherein a cushioning apparatus constructed in accordance with the invention has facilitated reception of a web roll after ejecting an empty roll core.

Referring more particularly to FIG. 1, a series of web rolls are illustrated being received from a suitable delivery mechanism such as a conveyor 10. Each of the web rolls in addition to the web W include core rolls 11 upon which the web is wound. The web rolls are received upon an inclined table 12 provided with a series of stops or gates 13 and 14. The gates 13 and 14 are pivotably mounted on the table as at 15 and each has an upright member 16 at an opposite end to facilitate positioning of the web rolls W to be fed onto the let-off. The linkage mechanisms 17 for operating each of the gates 13 and 14 are in turn operated by an air cylinder 18 through a suitable link 19.

Figure 2:
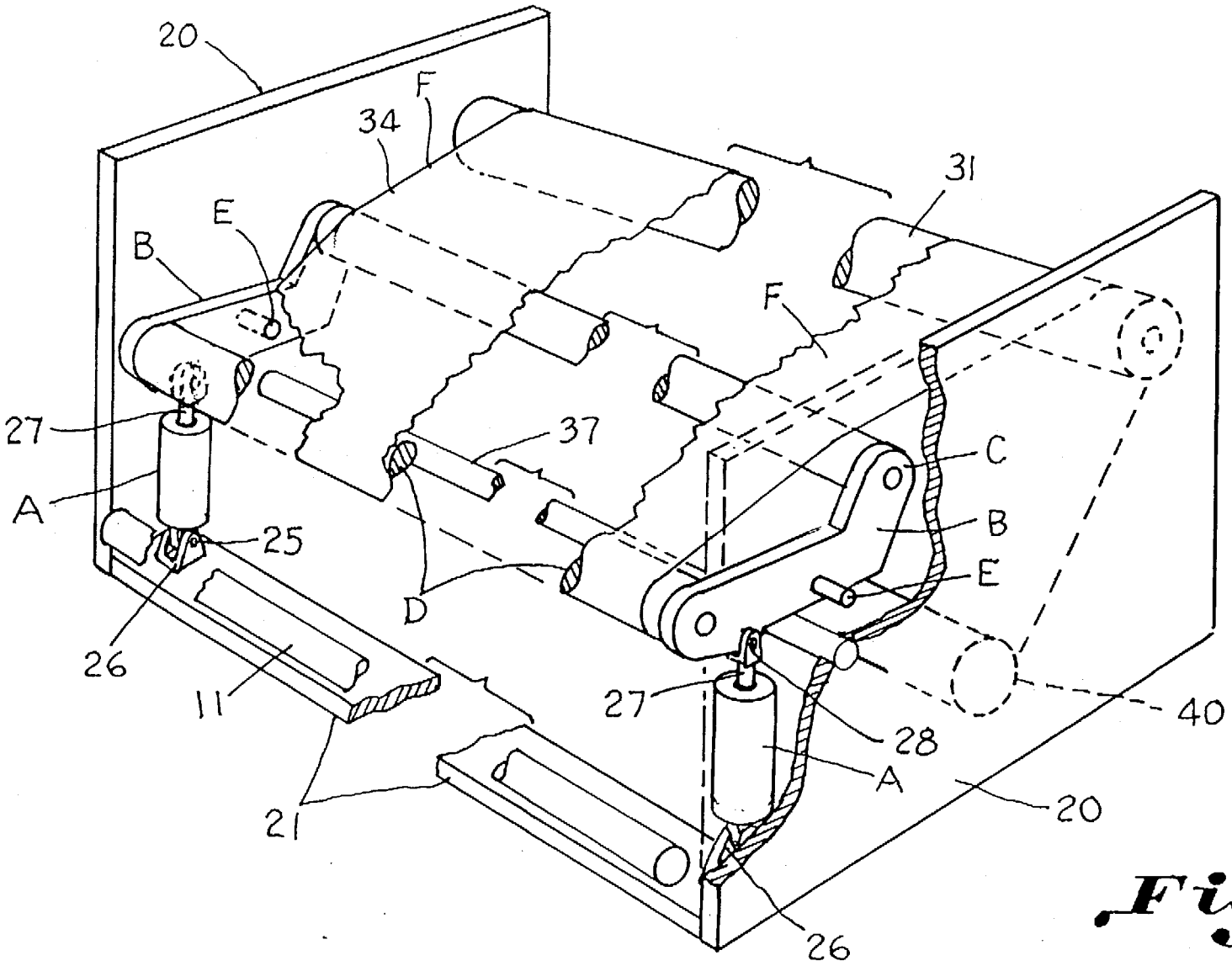
FIG. 2 is a perspective view, with parts omitted and parts broken away, looking toward a front or reception end of the belt let-off illustrating the pneumatic device and pivoted arms operated thereby for ejecting a roll core and for receiving and cushioning a full web roll in accordance with the invention.

Referring more particularly to FIGS. 1 and 2, it will be observed that the let-off includes opposed end frame members 20 which are bridged by suitable longitudinally spaced transverse frame members 21. An automatic sewing machine is illustrated in FIG. 1 and broadly designated at 22. FIG. 1 further illustrates a frame member 23 one of which is located at each end of the let-off above respective end frame members 20. Each frame member 23 carries a core guide 24 depending therefrom on each side of the web roll core rolls 11 to limit the transverse movement of the web rolls W on the belt let-off illustrated in the drawings.

A first support includes a pneumatic device A which includes a pair of spaced cylinders, one of which is preferably carried by a forward most longitudinal support member 21 adjacent each of the respective end frame members 20. The pneumatic device or cylinders A are pivotably connected at their bases as at 25 to brackets 26 carried by the horizontal frame member 21. The pneumatic cylinders have piston rods 27 which extend upwardly into pivotal engagement with the bell crank arms B as at 28.

The bell crank arm B includes an outwardly extending link 29 and a link 30 extending at a suitable angle to the link 29. The links 29 carry a roll C for rotation therebetween while the links 30 carry the roll D for rotation adjacent the free end thereof opposite the roll C. The arms B are pivoted intermediate their ends at the juncture of the links 29 and 30 as at E on respective frame members 20. A second support includes an endless belt F which is disposed between the movable upper roll D carried between the pivoted arms B and the fixed roll 31 which is journaled at its respective ends in respective end frame members 20. The rolls D and 31 are generally parallel and in substantially the same horizontal plane so as to form a cradle 32 therebetween. The rolls D and 31 support substantially the entire weight of the web roll W on the cradle 32 during substantially the entire unwinding operation.

Operation

At the end of an unwinding operation the empty roll cores 11 are ejected from the cradle as illustrated in FIG. 2 and the roll cores 11 fall into a trough 33 provided for collecting them as illustrated in FIG. 1.

In order to eject the empty roll cores at the cessation of unwinding the air cylinders A move the roll D from an upper position shown in FIG. 1 to a lower position in FIG. 1 corresponding to that of the roll D in FIG. 2. At this stage of the sequence the belt F is pulled taut between the roll 31 and the lowered roll D to form an inclined flat surface illustrated as at 34 in FIGS. 1 and 2. The flat surface of the belt 34 which normally forms the cradle 32 causes the empty roll cores 11 to roll off and be thus ejected from the belt F.

Figure 3:
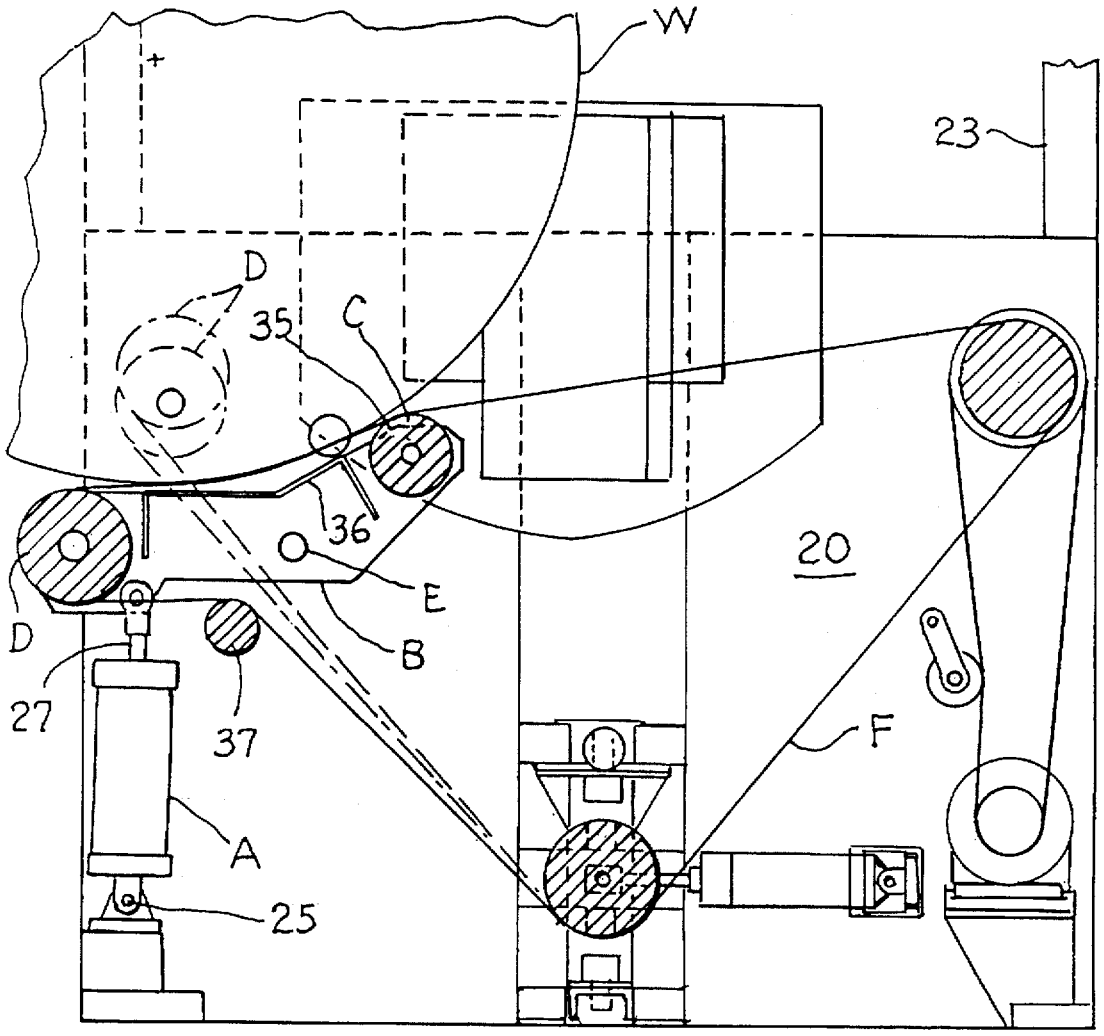
FIG. 3 is an enlarged side elevation further illustrating the belt let-off with the parts in position for receiving and cushioning the placement of a web roll preparatory to lowering same into operating position upon the belt.

FIG. 3 illustrates the initial phase of introducing a new web roll W onto the belt F forming the second support. It will be noted in FIG. 3 that the roll D is illustrated as at being still lowered somewhat and that an arcuate depression 35 is formed in the belt F for accommodating the web roll W. The web roll W is supported on the web roll C on an inner portion of the let-off while a support stand is provided as at 36 for temporarily supporting the web roll W when it is initially placed upon the belt F. It will be observed that the rotatable roll 37 has its ends in respective end frame members 20 and it acts to tighten the belt F as shown in FIG. 3 upon the lowering of the roll D.

Figure 4:
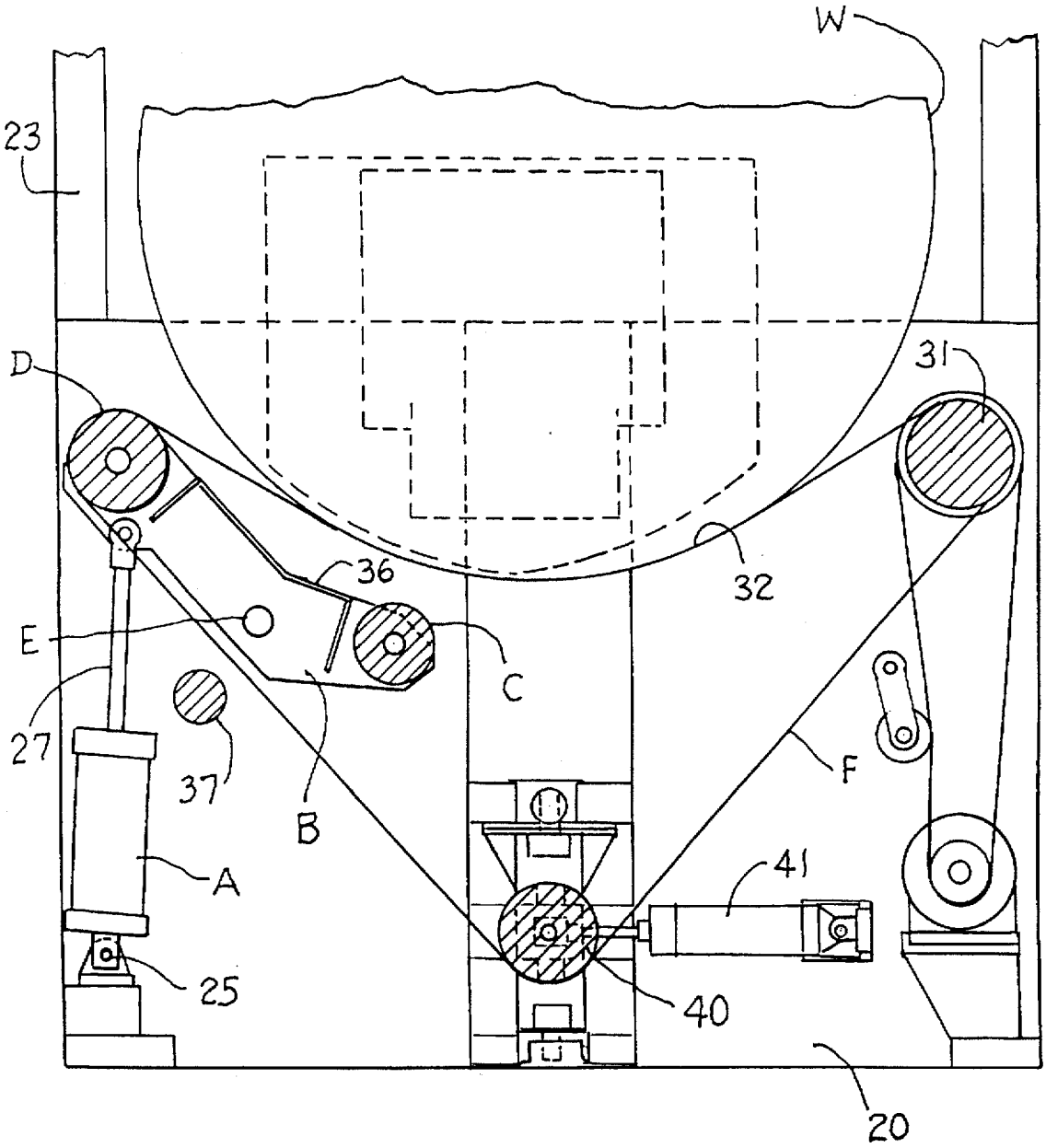
FIG. 4 is a side view, similar to FIG. 3, illustrating the web roll in lowered position supported in a cradle formed in the belt for carrying out an unwinding operation with the cushioning apparatus in retracted position.

Referring now more particularly to FIG. 4, it will be observed that the piston rods 27 of the air cylinders are extended and that the web roll W is now fully received within the cradle 32 formed by the belt F and is in position for rotation by the belt for unwinding the web W. In FIG. 4 the bell crank arms B and the roll C are in retired position with the roll D in operating position with respect to the fixed roll 31 for supporting the belt F in its generally triangular configuration forming the cradle 32. The belt is supported at its lower portion by a guide roll 40 which may be suitably operated by a cylinder operator as at 41 to guide the belt upon the rolls D, 31 and 40. The core guides 24, in turn, limit the lateral movement of the web rolls W upon the belt F during unwinding.

FIG. 5 illustrates the components for operating the air cylinders A wherein a two position solenoid valve 45 is actuated by a programmable logic controller PLC to lower the belt let-off gate 14. Suitable flow control valves broadly designated as at 46 are illustrated in FIGS. 5 and 5-A. The diagram of FIG. 5-A illustrates the details of the valves 46 provided as check flow valves. The flow control valves 46 control the flow of air out of the air cylinder as to regulate the speed of which the gate 14 is raised by actuation of the solenoid 45. The flow control valves control such speed during the lowering of the web roll into position within the cradle 32 formed in the belt F. Air is permitted to flow from an upper end of air cylinders A in order to cushion the descent of the web roll when placed upon the let-off.

It is thus seen that an apparatus and method has been provided for efficiently receiving the web rolls upon their initial placement upon a let-off and, in particular, a belt-let off as illustrated. The placement of the web roll upon the belt is accomplished with a minimal amount of impact and resulting noise at the conclusion of the step in the dewinding operation wherein the core roll is ejected from the let-off. With the parts in this position with the belt taught and inclined downwardly as illustrated at 34 the web roll is received upon the roll C on the arm B.

While a preferred embodiment of the invention has been described using specific terms, such description is for illustrative purposes only, and it is to be understood that changes and variations may be made without departing from the spirit or scope of the following claims.

What is claimed is:

1. The method of cushioning the impact of a web roll when the web roll is placed upon a let-off having a driven endless belt forming a cradle between and supported by a pair of spaced support rolls for carrying said web roll during unwinding comprising the steps of:

receiving said web roll on said endless belt and carrying a substantial portion of the weight of said web roll upon a pneumatic device comprising an intermediate roll positioned between said support rolls and under said belt and carried in a raised position by axially spaced pneumatic cylinders mounted on the let-off from which cylinders air is exhausted under the weight of said web roll on said intermediate roll permitting said intermediate roll and the web roll carried thereby to be gradually lowered against a cushioning support of air in said pneumatic device for placement of the web roll upon the let-off for support on said cradle; and said raised position being directly adjacent a portion of said belt on which said web roll is received when said belt is taut between said support rolls;

receiving and supporting the web roll upon the endless belt when the web roll is lowered into a position on the let-off for rotation during unwinding;

whereby the full web roll is received upon said pneumatic device and gradually lowered by gravity against said cushioning support of air into position for unwinding upon the let-off.

2. The method set forth in claim 1 including the step of ejecting a web roll core from the let-off by the action of said pneumatic device prior to the step of receiving and carrying a substantial portion of the weight of the web roll.

3. The method set forth in claim 2, including the step of simultaneously tightening said endless belt for ejecting said web roll core while positioning said endless belt for receiving said web roll responsive to said pneumatic device.

4. The method set forth in claim 1 including the step of supporting one of said support rolls and said intermediate roll respectively on front and back ends of a bell crank arm and exerting a downward force upon a front end of said bell crank arm by means of said pneumatic device for ejecting a web core.

5. The method of cushioning the impact of a web roll when the web roll is placed upon a let-off having a pair of spaced support rolls for carrying said web roll during unwinding comprising the steps of:

receiving said web roll on said let-off and carrying a substantial portion of the weight of said web roll upon a pneumatic device comprising an intermediate roll positioned between said support rolls and carried in a raised position by axially spaced pneumatic cylinders mounted on the let-off from which cylinders air is exhausted under the weight of said web roll on said intermediate roll permitting said intermediate roll and the web roll carried thereby to be gradually lowered against a cushioning support of air in said pneumatic device for placement of the web roll upon the let-off for support on said spaced support rolls; and said raised position being directly adjacent a line connecting the uppermost surfaces of said support rolls;

receiving and supporting the web roll upon the spaced support rolls when the web roll is lowered into a position on the let-off for rotation during unwinding;

whereby a full web roll is received upon said pneumatic device and gradually lowered by gravity against said cushioning support of air into position for unwinding upon the let-off.

* * * * *